US007868529B2

(12) United States Patent
Li

(10) Patent No.: US 7,868,529 B2
(45) Date of Patent: Jan. 11, 2011

(54) PENETRABLE ASSEMBLED MAGNETIC ENERGY GENERATOR AS WELL AS ITS MAGNETIC LIGHT

(76) Inventor: Jin Li, No. 201, Unit 3, Building 11, DongHua Garden, ShiJi Town, PanYu District, Guangzhou, Guangdong (CN)

( * ) Notice: Subject to any disclaimer, the term of this patent is extended or adjusted under 35 U.S.C. 154(b) by 1041 days.

(21) Appl. No.: 10/586,508

(22) PCT Filed: Dec. 20, 2005

(86) PCT No.: PCT/CN2005/002260

§ 371 (c)(1), (2), (4) Date: Jul. 17, 2006

(87) PCT Pub. No.: WO2006/066504

PCT Pub. Date: Jun. 29, 2006

(65) Prior Publication Data

US 2008/0093966 A1 Apr. 24, 2008

(30) Foreign Application Priority Data

Dec. 22, 2004 (CN) ..... 2004 1 0091802

(51) Int. Cl.
*H01J 1/50* (2006.01)
*H01F 1/00* (2006.01)

(52) U.S. Cl. ..... 313/153; 315/248; 335/209

(58) Field of Classification Search ..... 313/153–162; 315/248, 267, 344; 335/209, 212, 219
See application file for complete search history.

(56) References Cited

U.S. PATENT DOCUMENTS 4,163,826 A * 8/1979 Kawaguchi et al. ..... 428/371
4,547,705 A * 10/1985 Hirayama et al. ..... 315/219
5,395,218 A * 3/1995 Thompson ..... 417/416
5,834,905 A * 11/1998 Godyak et al. ..... 315/248

* cited by examiner

*Primary Examiner*—Mariceli Santiago
*Assistant Examiner*—Anthony T Perry
(74) *Attorney, Agent, or Firm*—Raymond Y. Chan; David and Raymond Patent Firm

(57) ABSTRACT

The present invention discloses a magnetic light, having a magnetic energy generator, and a light body having at least a through slot for penetrating the energy generator, the magnetic energy generator includes a pair of detachable magnetic members jointed together with a face to face manner for defining a magnetic air gap between two magnetic members, as a result, the magnetic field center could be accurately positioned, wherein one of the magnetic members is adapted to penetrate the through slot to be coupled with the remaining magnetic member. In short, such magnetic light has a simpler structure, and solid cost saving, and more importantly prone to be manufactured with an industrial scale.

19 Claims, 7 Drawing Sheets

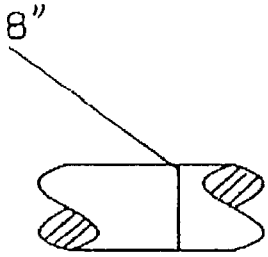
Fig. 2.3
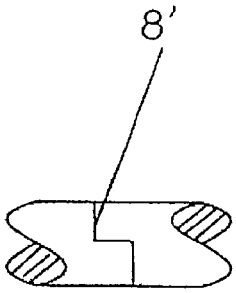
Fig. 2.2
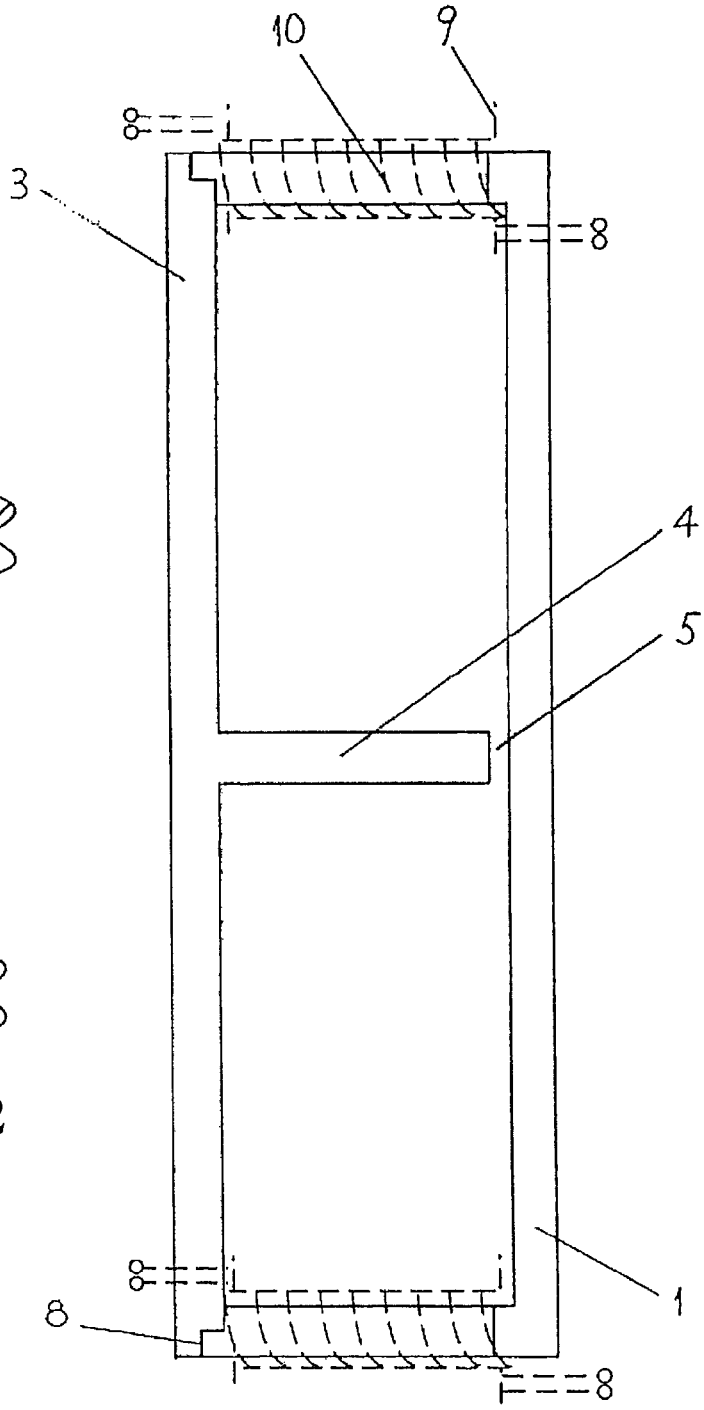
Fig. 2.1

PENETRABLE ASSEMBLED MAGNETIC ENERGY GENERATOR AS WELL AS ITS MAGNETIC LIGHT

BACKGROUND OF THE PRESENT INVENTION

1. Field of Invention

The present invention relates to luminous means, and more particularly, relates to a kind of magnetic light utilizing an assembled magnetic generator for activating a luminous body to shine up the light.

2. Description of Related Arts

Magnetic lights utilize high-frequency magnetic energy resonance theory to replace conventional filament illumination theory, which employs LC series filaments having fluorescent electrode, wherein the electrode could be heated to activate fluorescent powder for illumination. By applying the magnetic lights, the luminous efficiency would be significantly improved as much as 20% and the fluorescent light-attenuating phenomena could be neglected. And more importantly, the life-span of the light could be extended 16 times, the energy-saving efficiency could be increased around 35-45%, and the input efficiency could achieve 6 W-1500 W. however, the electrodeless lamp and the electromagnetic light introduced into the market had been complained about the inefficient structure and expensive costs. The embodied electromagnetic light could not achieve the prospective efficiency claimed by the magnetic light. For example, the input power of the light could not exceed 165 W, and the luminous efficiency could not exceed 601 m/W. That is to say, the magnetic light is still lingered within the initiating phrase after 15 years efforts, and is still far from wide development and spread in the market.

The high frequency electromagnetic induction device has been widely considered as a bottleneck of an efficient electromagnetic lamp. Commonly, the electromagnetic induction device comprises a magnetic core, which is embodied as a pair of detachable inductive magnetic elements, wherein such magnetic core could not be securely positioned. The magnetic air-gap between the on-off positions of the magnetic ring is randomly determined and no accurate positioned could be ensured. As a result, the electromagnetic equivalent could not be managed in applications. On the other hand, the electromagnetic induction coil is winded onto respective magnetic core, wherein the distance between two half circle of the electromagnetic core is undetermined and the magnetic air-gap is randomly selected as well. As a result, the electromagnetic intensity of the closed circuit could not be measured. Furthermore, the separated magnetic body have been disposed with an unstable condition, wherein the distance, relative position, gap, space and air-gap between each other could not be secured, thus resulting the magnetic core working in a constantly unstable status. What is more, the soft magnetic ferrite of the electromagnetic induction device could not be relatively secured at a fixed position, after the circuit is charged to enable the induction magnetic filed to shine up the light, the high temperature emitted from the lamp and the soft magnet ferrite would affect the magnetic material thus generating expanding of the materials, as a result, the magnetic filed intensity could be not controlled. The magnetic filed voltage could not be controlled as well; the constantly soared magnetic current would result to the instability of the physical property of the magnetic materials provided onto the magnetic coil. Furthermore, the magnetic air-gap would be continuously enlarged thanks to the unstable magnetic field intensity and the high temperature of the lamp, thus forming an uncontrollable cycle, i.e. the current and voltage would be increased as well. Accordingly, such increased current and voltage would affect the resonance oscillating frequency of the magnetic ring, such variance of the oscillating frequency would output power of the lamp gradually increased.

SUMMARY OF THE PRESENT INVENTION

A primary object of the present invention is to provide a magnetic energy generator, having a pair of separated magnetic body for winding electromagnetic induction coils thereon, wherein two separated magnetic bodies are secured with other at stable space, position, gap, and distance so as to generate a fixed magnetic air gap therebetween, and more importantly, to form an ensured electromagnetic intensity of a completed magnetic circuit.

Accordingly, to achieve above object, the present invention provides a magnetic generator, comprising a pair of detachable magnetic bodies coupled with each other at a face to face manner to complete a magnetic circuit, wherein a fixed magnetic air gap is formed therebetween for accurately positioning a magnetic field center of the magnetic circuit, and for ensuring an electromagnetic induction current volume.

According to the present invention, the magnetic body further comprises a bakelite frame for enwinding electromagnetic induction coil. It is noted that the fixed magnetic air gap is capable of ensuring the electromagnetic induction current, therefore, the manageability and the reliability of the electromagnetic circuit could be enormously improved. Ultimately, the compatibility and quality of the product could be under control of the manufacturer so as to pave the way for industry-scale production.

It is noted that the magnetic body of the present invention has two separated magnetic members detachably coupled with each other at a face to face manner, wherein one of such magnetic members is a trough-type body having a projected pin, the other magnetic member has a straight flange correspondingly mated with the projected pin, wherein the straight flange is spacedly part with the projected pin for forming a fixed air gap there between, and an insulated bakelite frame is provided onto the projected pin and the straight flange for enwinding the electromagnetic induction coils, wherein a pair of engaging shoulders are respectively provided at the magnetic members for facilitating two magnetic members accurately coupled together.

Or otherwise, the magnetic body of the present invention has two separated magnetic members detachably coupled with each other at a face to face manner, wherein one of the magnetic member is a trough-shaped body, the other magnetic member has a straight flange inserted into the trough-shaped body, wherein a fixed air gap is defined between the straight flange and the trough-shaped body, such that an insulated bakelite frame is provided to the magnetic body at a position adjacent to the air gap for enwinding an electromagnetic induction coil, wherein two engaging shoulders respectively defined at two side ends of the magnetic members for ensuring two magnetic members detachably coupled with each other to form a magnetic body.

Or otherwise, the magnetic body of the present invention has two separated magnetic members detachably coupled with each other at a face to face manner, wherein each of the magnetic members is C-shape defined having an engaging end coupled to the counterpart magnetic member, and a magnetic end spacedly part with the counterpart end of the another magnetic member, such that when such pair of magnetic members engaged with a face to face manner, a fixed air gap would be defined there between, wherein a bakelite frame is provided at a position adjacent to the air gap for enwinding an electromagnetic induction coil. There are two engaging shoulders respectively defined at two engaging ends of the magnetic members for ensuring positioning the magnetic body.

Or otherwise, the magnetic body of the present invention has two separated magnetic members detachably coupled with each other at a face to face manner, wherein each of the magnetic member is a trough-shape body having a pin projected from a central portion therein with a height below the edge of the trough-shape body, such that when such pair magnetic members approach with each other to engage together with a face to face manner, such projected pins approach as well to form an air gap there between, wherein an insulated bakelite frame is provided around the air gap for enwinding an electromagnetic induction coil. There are two engaging shoulders respectively defined at two side ends of the magnetic member for ensuring two magnetic members detachably coupled with each other to form the magnetic body. It is noted that the trough-shape body could be defined as rectangle shape, half-circle shape, or any other shapes.

Or otherwise, the magnetic body of the present invention has two separated magnetic members detachably coupled with each other at a face to face manner, wherein each of the magnetic member has at least one engaging shoulder mated with each other for securely coupling two magnetic members together. Or otherwise, two magnetic members could be attached together with a face biasing manner. An air gap is defined between two magnetic members for positioning a magnetic field center.

According to the present invention, the magnetic light comprises a light body having a through slot, a magnetic energy generator having a pair of separated magnetic members, namely a first magnetic member and a second magnetic member, wherein the first magnetic members is inserted into the through slot, and the second magnetic member is arranged to couple with the first magnetic member with a face to face manner for defining a completed air gap there between, a bakelite frame provided at the air gap for enwinding an electromagnetic induction coil thereon.

Accordingly, the magnetic light of the present invention comprises a light body having a through slot and a magnetic energy generator, wherein the magnetic energy generator has a magnetic body having two separated magnetic members detachably coupled with each other at a face to face manner to for a closed magnetic air gap, wherein one of the magnetic member is inserted into the through slot of the light body, such that when two magnetic member approach with each other, two magnetic members will couple with each to define the magnetic air gap.

It is noted that the insulated bakelite frame could be disposed to the light body of the magnetic light for enwinding an electromagnetic induction coil.

The electromagnetic induction coil is regularly winded onto the bakelite frame provided at the magnetic air gap, wherein the winding position is accurate with an even manner so as to ensure the electromagnetic induction coil confronts all surfaces of the magnetic light body for increasing the electromagnetic efficiency. What is more, the electromagnetic induction coil could be applied as a single multi-enamel wire wrapped by insulated casing, or be applied as two or four of parallel entwisted multi-enamel wires wrapped by insulated casing. Moreover, the electromagnetic induction wire could be winded onto the bakelite frame with a complete circle or as many as N circles. Finally, the electromagnetic induction coil could be applied as a plurality of wires wrapped within an insulated casing with varied diameter or varied quantity, or otherwise embodied as copper wires wrapped by the insulated casing.

Accordingly, the magnetic light of the present invention has a relative simpler structure, and several distinctive features, such as easier installation, simple manufacturing procedure, low costs, and more importantly, a relative securer and fixed magnetic air gap between two detachable magnetic members. As a result, the electromagnetic intensity of the closed magnetic circuit could be ensured thus guaranteeing magnetic body with a stable condition after such electrical circuit being charged to generate the magnetic field, induction voltage and induction current. Moreover, the magnetic body is arranged to contact with the light body at many fronts for enhancing the electromagnetic efficiency, i.e. there are 6-28 interfaces defined between the light surface and the magnetic body. Furthermore, there are two correspondingly mated magnetic fields, four planar magnetic fields, are provided for increasing the contacting surface of the magnetic fields. According to the present invention, the electromagnetic induction efficiency could be increased as far as 2-4 times.

Accordingly, the electromagnetic induction field will be performing within the closed magnetic circuit. The magnetic lines will be restricted within two corresponding magnetic fields of the closed magnetic circuits. The work provided by the electromagnetic induction current will be serviced to the light body, which is relied upon the electromagnetic energy of the magnetic body. The magnetic line will along the magnetic field to act onto the different magnetic surfaces of the magnetic light body. As a result, the magnetic radiation will be significantly reduced and the electromagnetic efficiency will be improved. In short, the magnetic energy generator enables the electromagnetic induction current and resonance frequency controllable and manageable in practices. The magnetic members have engaging shoulders respectively defined at two side ends for intensifying the relative positioning and attaching status, and more importantly, the fixed magnetic air gap will guarantee the electromagnetic induction current well calculated and measured in applications. Undoubtedly, the electrical circuit will be simple thanks to the magnetic energy generator of the present invention. The manufacturing cost will be saved since the generality and consistency of the products will be enormously improved for industry scale production.

These and other objectives, features, and advantages of the present invention will become apparent from the following detailed description, the accompanying drawings, and the appended claims.

BRIEF DESCRIPTION OF THE DRAWINGS

FIG. 2-1 is schematic view of the magnetic energy generator according to an alternative mode of the second embodiment of the present invention.

FIG. 2-2 is a perspective view showing engaging shoulders for coupling the trough-shape magnetic member and the T-shape magnetic member.

FIG. 2-3 is a perspective view showing engaging surface of respective magnetic members according to the present invention.

FIG. 3 is a schematic view of a magnetic energy generator according to a third embodiment of the present invention.

DETAILED DESCRIPTION OF THE PREFERRED EMBODIMENT

Figure 1:
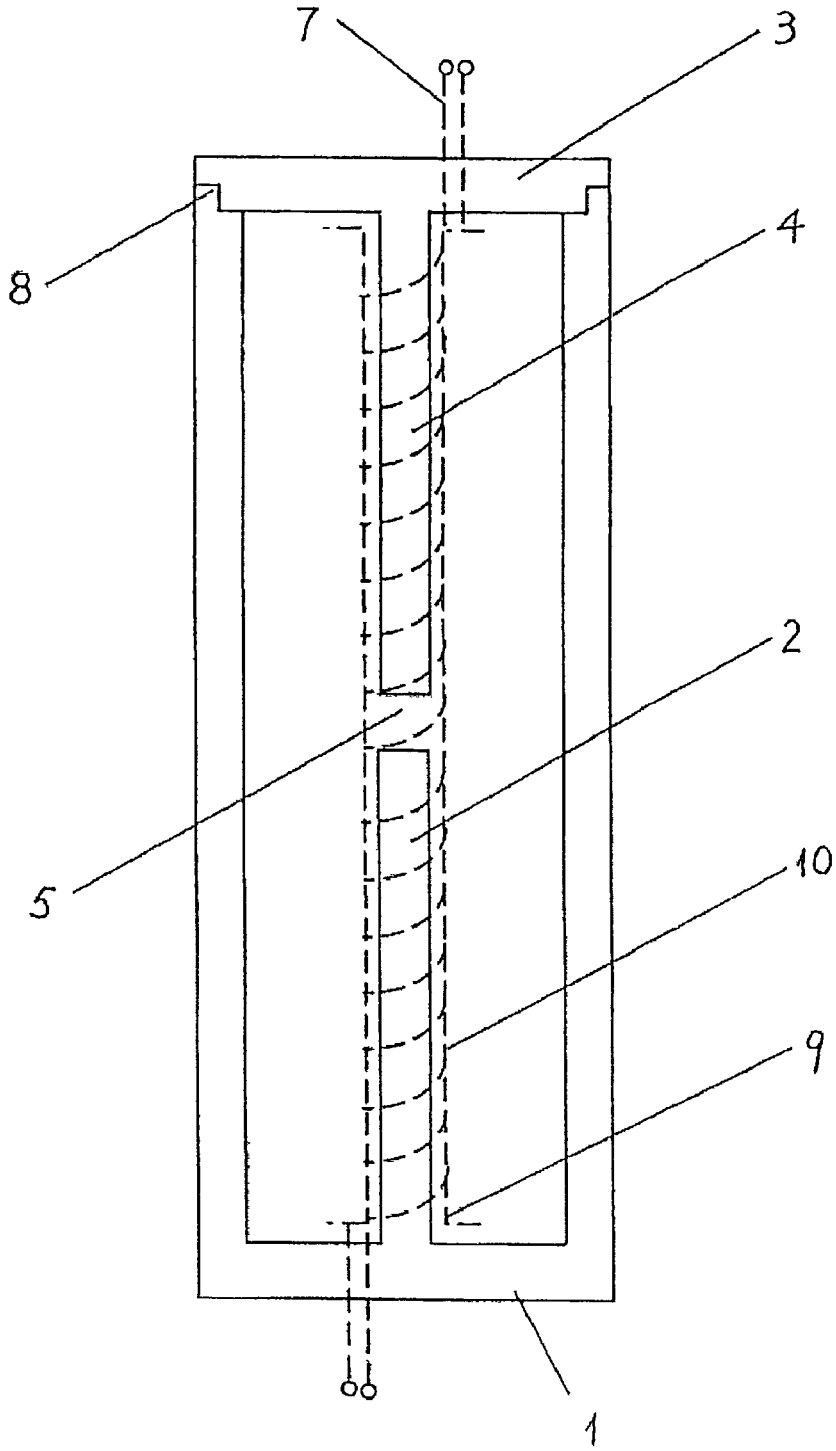
FIG. 1 is a schematic view of a magnetic energy generator according to a preferred embodiment of the present invention.

Referring to FIG. 1, the magnetic energy generator according to the present invention is illustrated, wherein the magnetic energy generator 1 is an assembled magnetic body comprising a pair of detachable magnetic members, namely a trough-shaped magnetic member 1 having a pin 2 projected from a central portion thereof and a T-shaped magnetic member 3, jointed with each other at a face to face manner for covering the trough-shaped magnetic member 1. Furthermore, the T-shaped magnetic member 3 has an elongated inserter probed into the trough-shaped magnetic member 1 in such a manner that a magnetic air gap is defined between the elongated inserter 4 and the projected pin 2, the T-shaped magnetic member 3 further comprises a pair of engaging shoulders 8 respectively provided at two side ends of the magnetic member 3 for correspondingly coupling with the mated engaging shoulders provided at two side ends of the magnetic member 1. The magnetic energy generator further comprises an insulated bakelite frame 9 provided onto the projected pin 2 and the elongated inserter 4 for enwinding an electromagnetic induction coil 10, which is electrically connected to a lead-in wire 7.

Figure 2:
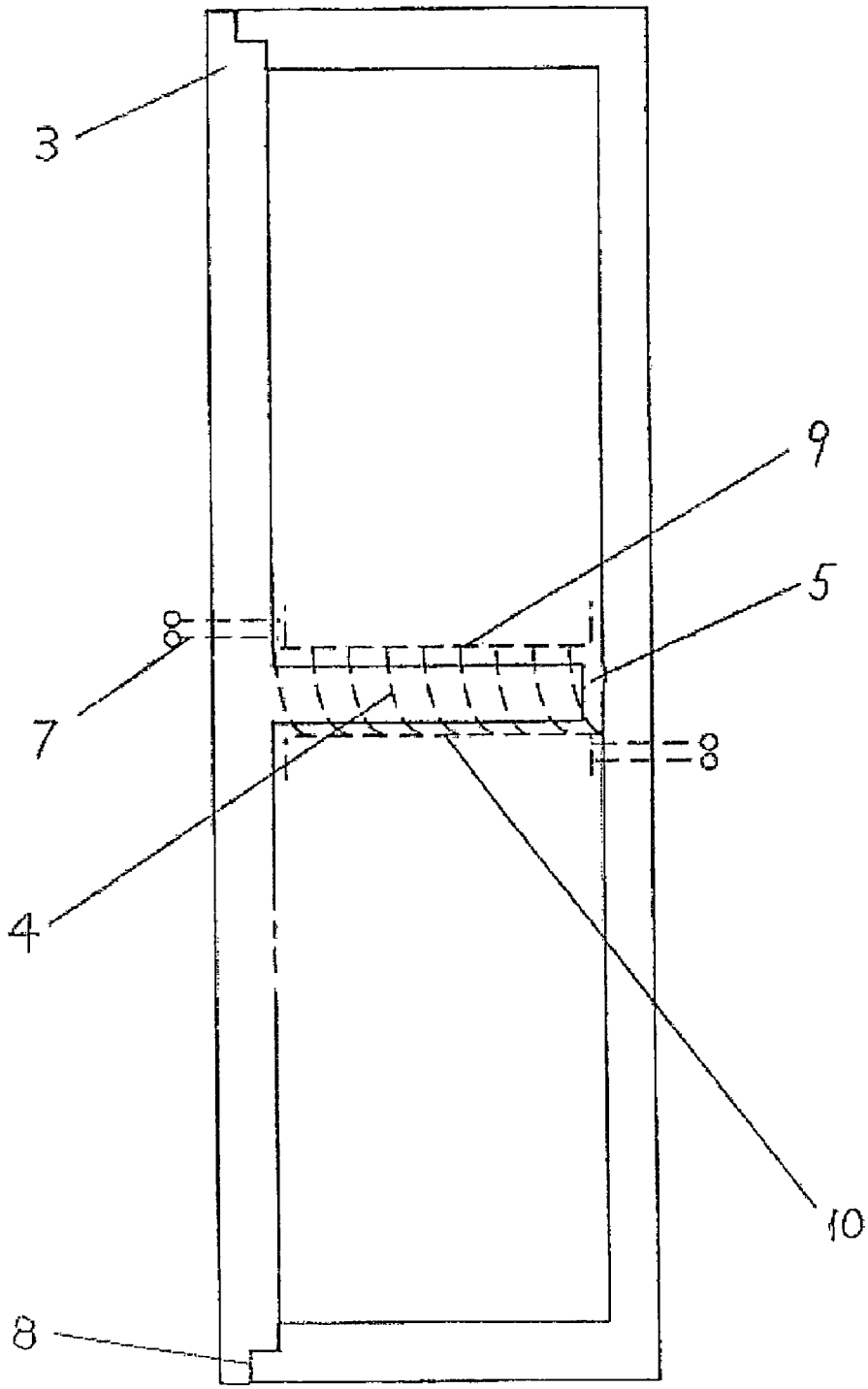
FIG. 2 is a schematic view of a magnetic energy generator according to a second embodiment of the present invention.

As shown in FIG. 2, the magnetic energy generator 1 is an assembled magnetic body comprising a pair of detachable magnetic members, namely a trough-shaped magnetic member 1 and a T-shaped magnetic member 3, jointed with each other at a face to face manner, wherein the T-shaped magnetic member 3 is arranged to cover the trough-shaped magnetic member 1. Furthermore, the T-shaped magnetic member 3 has an elongated side inserter probed into the trough-shaped magnetic member 1 in such a manner that a magnetic air gap 5 is defined between the elongated side inserter 4 and trough-shaped magnetic member 1, the T-shaped magnetic member 3 further comprises a pair of engaging shoulders 8 respectively provided at two side ends of the magnetic member 3 for correspondingly coupling with the mated engaging shoulders provided at two side ends of the magnetic member 1. The magnetic energy generator further comprises an insulated bakelite frame 9 provided onto the magnetic air gap 5 for enwinding an electromagnetic induction coil 10.

As shown in FIG. 2-1, the magnetic energy generator 1 is an assembled magnetic body comprising a pair of detachable magnetic members, namely a trough-shaped magnetic member 1 and a T-shaped magnetic member 3, jointed with each other at a face to face manner, wherein the T-shaped magnetic member 3 is arranged to cover the trough-shaped magnetic member 1. Furthermore, the T-shaped magnetic member 3 has an elongated side inserter probed into the trough-shaped magnetic member 1 in such a manner that a magnetic air gap 5 is defined between the elongated side inserter 4 and trough-shaped magnetic member 1, the T-shaped magnetic member 3 further comprises a pair of engaging shoulders 8 respectively provided at two side ends of the magnetic member 3 for correspondingly coupling with the mated engaging shoulders provided at two side ends of the magnetic member 1. The magnetic energy generator further comprises a pair of insulated bakelite frames 9 respectively provided onto two side arms of the trough-shaped magnetic member 1 for enwinding a pair of electromagnetic induction coils 10.

As shown in FIG. 2-2, the engaging shoulders of the trough-shaped magnetic member 1 and the T-shaped magnetic member 3 are embodied as terraced mating surfaces for engagement.

Figure 3:
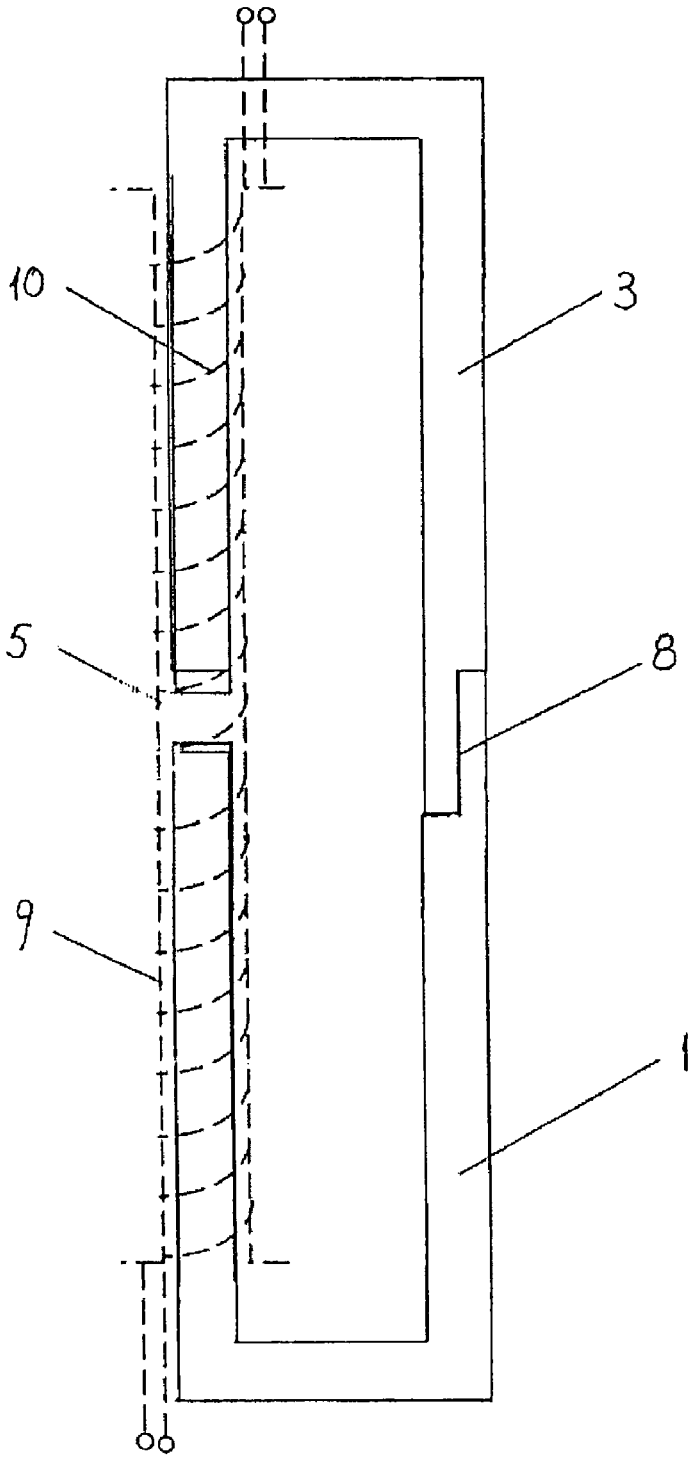

As shown in FIG. 2-3, the engaging shoulders of the trough-shaped magnetic member 1 and the T-shaped magnetic member 3 are embodied as flat mating surfaces for engagement.

As shown in FIG. 3, the magnetic energy generator 1 is an assembled magnetic body comprising a pair of detachable trough-shaped magnetic members, namely a first magnetic member 1 and a second magnetic member 3, jointed with each other at a face to face manner, wherein a first pair of side arms of the magnetic members are coupled together, while the remaining said arms are separated aligned for defining a magnetic air gap 5 there between. The magnetic energy generator further comprises an insulated bakelite frame 9 provided onto the magnetic air gap 5 for enwinding an electromagnetic induction coils 10.

Figure 4:
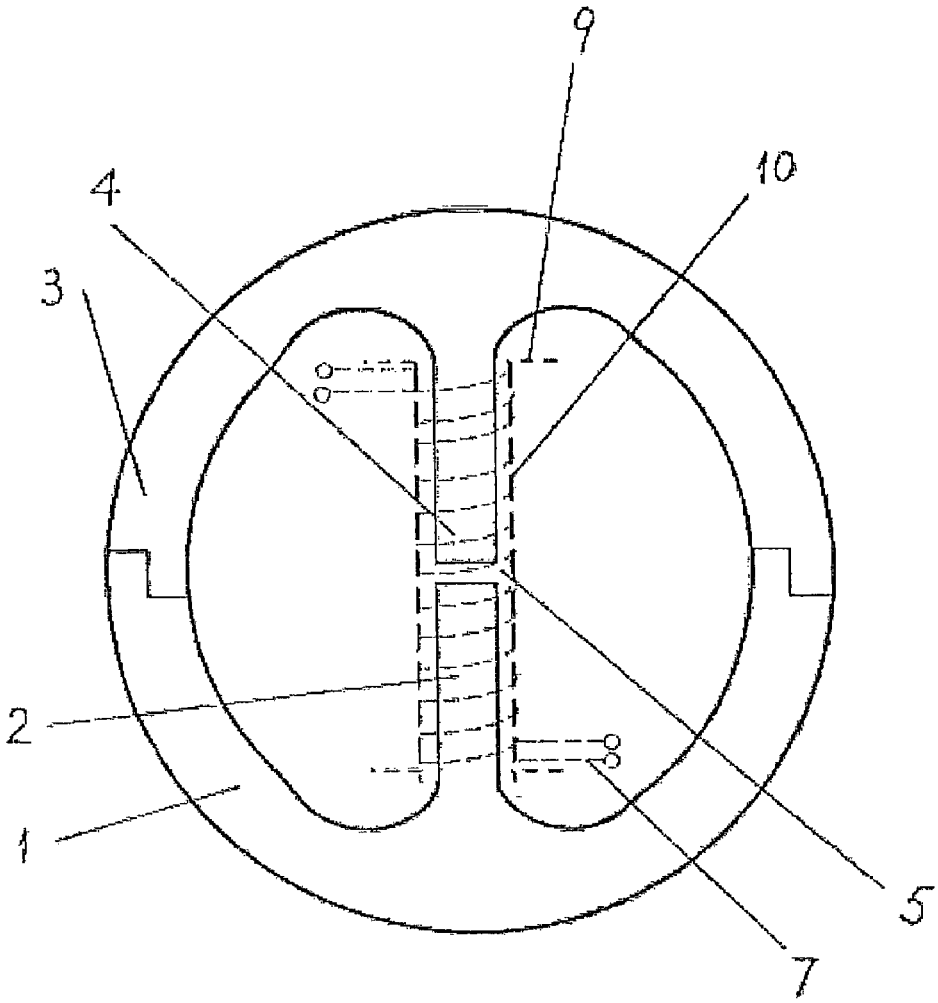
FIG. 4 is a schematic view of a magnetic energy generator according to a fourth embodiment of the present invention.

As shown in FIG. 4, the magnetic energy generator 1 is an assembled magnetic body comprising a pair of detachable trough-shaped magnetic members, namely a first magnetic member 1 and a second magnetic member 3, jointed with each other at a face to face manner, wherein each of the trough-shaped magnetic member has a tongue protruded from the magnetic member body in such a manner when two magnetic members approach with each other to form the magnetic body, two tongues respectively extended from two magnetic members will approach as well to define a magnetic air gap there between. The magnetic energy generator further comprises an insulated bakelite frame 9 provided onto the magnetic air gap 5 for enwinding an electromagnetic induction coils 10.

Figure 5:
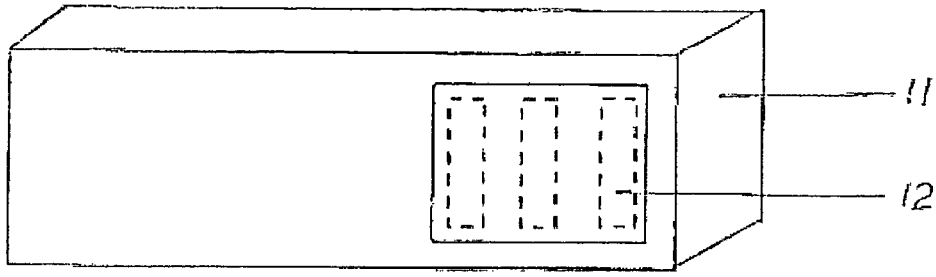
FIG. 5 is a schematic view of a magnetic light body according to the present invention.

As shown in FIG. 5, the magnetic light of the present invention comprises a light body 11 having at least a through slot 12 defined thereon for penetrating the magnetic energy generator. The light body 11 is an airproof hollow body having an inner cavity coated with fluorescent powder, and filled with inert gases and predetermined quantities of mercury. It is noted that the pressure within the light body is no less than 300 mp.

Figure 6:
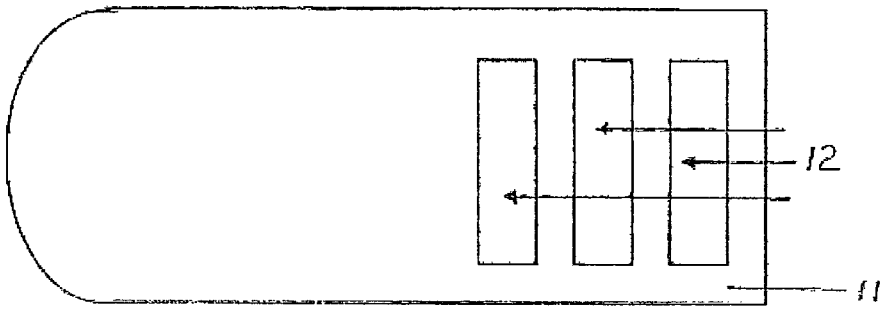
FIG. 6 is a schematic view of a magnetic light body according to the first embodiment of the present invention.

As shown in FIG. 6, the magnetic light of the present invention comprises a light body 11 having three through slots defined thereon for penetrating the magnetic energy generator, wherein two side arms and the central projected pin are respectively received within the three slots. The light body 11 is an airproof hollow body having an inner cavity coated with fluorescent powder, and filled with inert gases and predetermined quantities of mercury. It is noted that the pressure within the light body is no less than 300 mp.

Figure 7:
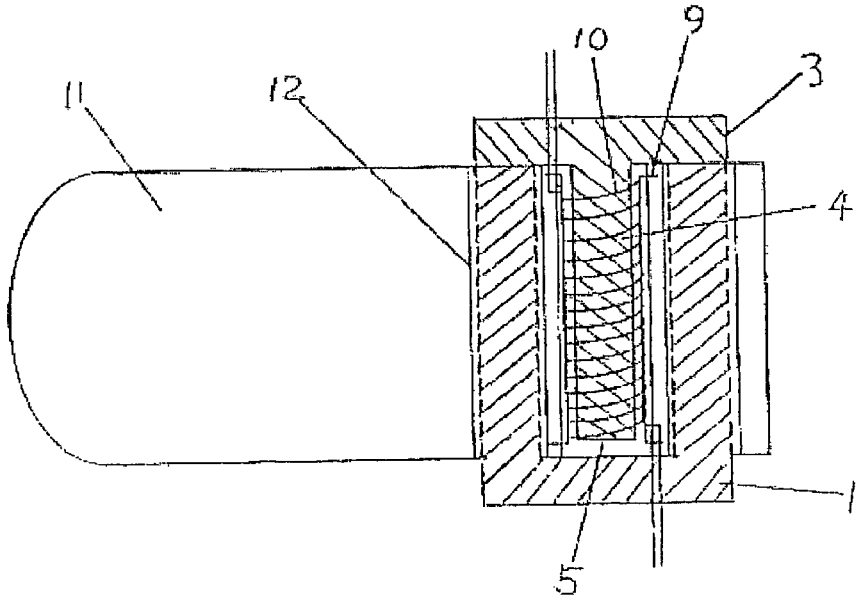
FIG. 7 is a schematic view of a magnetic light body according to the first embodiment of the present invention.

As shown in FIG. 7, the magnetic light of the present invention comprises a magnetic energy generator and a light body, wherein the light body has three through slots for receiving the magnetic energy generator, which is an assembled magnetic body comprising a pair of detachable magnetic members, namely a first trough-shaped magnetic member 1 and a second T-shaped magnetic member 3, jointed with each other at a face to face manner, wherein the T-shaped magnetic member further comprises an elongated intruder 4 sidewardly extended from the T-shaped magnetic member, such that when two magnetic members approach with each other, the elongated intruder 4 is probed into the trough-shaped magnetic member 1 to define a magnetic air gap 5 there between, an insulated bakelite frame 9 provided onto the elongated intruder 4 for enwinding an electromagnetic induction coils 10. It is noted that two side arms and the elongated intruder 4 are arranged to penetrate the light body vie three through slots for facilitating the T-shaped magnetic member 3 coupled onto the Trough-shaped magnetic member 1.

Figure 8:
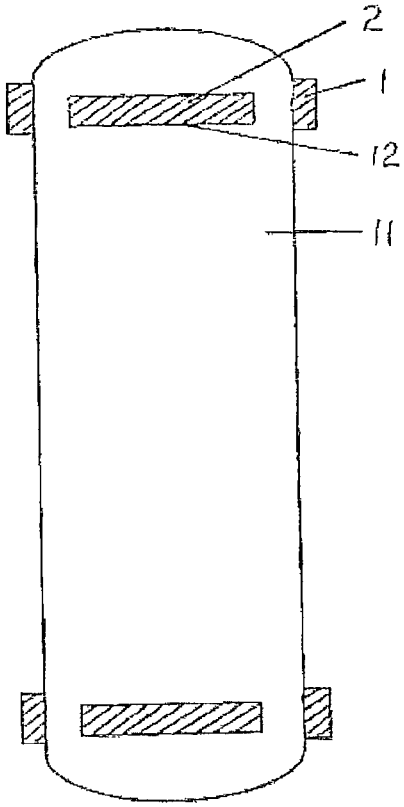
FIG. 8 is a schematic view of a magnetic light body according to the second embodiment of the present invention.
Figure 9:
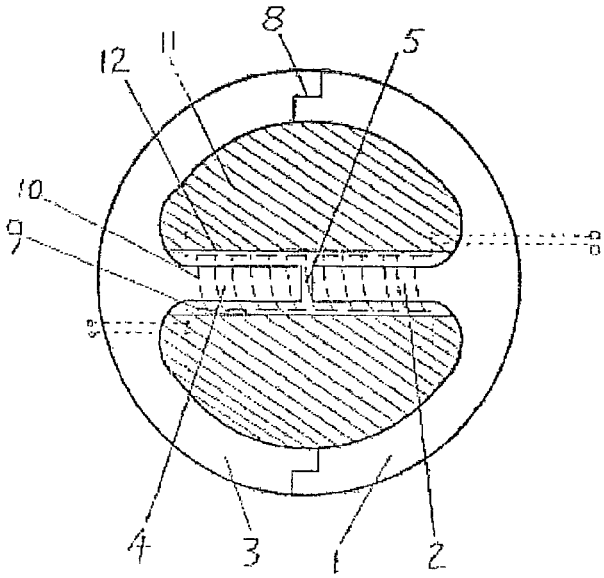
FIG. 9 is a schematic view of a magnetic light body according to the third embodiment of the present invention.

As shown in FIG. 8, the magnetic light of the present invention comprises a magnetic energy generator and a light body, wherein the light body has a through slot 12, and the magnetic energy generator is an assembled magnetic body comprising a pair of detachable magnetic members, each of which is trough-shaped having a projected pin extended from thereon, such that when such two magnetic member approach with each other, said two projected pin will approach as well to penetrate the through slot and define a magnetic air gap 5 there between, wherein an insulated bakelite frame 9 provided onto the magnetic air gap 5 for enwinding an electromagnetic induction coils 10. It is noted that two side arms of the magnetic members 1, 3 are respectively embodied as engaging shoulders for a precise alignment and engagement, and the light body is wrapped by two magnetic members.

It is noted that the insulated bakelite frame could be disposed at the light body of the magnetic light for enwinding the electromagnetic induction coil.

Conclusively, the electromagnetic coil of the present invention is regularly winded onto the insulated bakelite frame disposed at a position close to the magnetic gap of the closed magnetic circuits of the magnetic energy generator. As a result, winding process could be securely, evenly, universally executed for ensuring the electromagnetic induction coils interfaced with a plurality of contacting surfaces of the light body so as to ultimately increase the electromagnetic efficiency. What is more, the electromagnetic induction coil could be applied as a single multi-enamel wire wrapped by insulated casing, or be applied as two or four of parallel entwisted multi-enamel wires wrapped by insulated casing. Moreover, the electromagnetic induction wire could be winded onto the bakelite frame with a complete circle or as many as N circles. Finally, the electromagnetic induction coil could be applied as a plurality of wires wrapped within an insulated casing with varied diameter or varied quantity, or otherwise embodied as copper wires wrapped by the insulated casing.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A penetrable assemble magnetic energy generator for a magnetic light, comprising:

an assembled magnetic body, which comprises:

a first magnetic member, having a trough-shaped structure, comprising a projected pin extending therewithin; and a second magnetic member, which is engaged with and covered with said first magnetic member, comprising an elongated inserter extended into said first magnetic member and aligned with said projected pin to define a fixed magnetic air gap between said elongated inserter and said projected pin;

an insulated thermosetting frame extended from said projected pin to said elongated inserter; and an electromagnetic induction coil enwinding with said insulated thermosetting frame from said projected pin to said elongated inserter through said magnetic air gap.

2. The magnetic light, as recited in claim 1, wherein said insulated thermosetting frame is a insulated bakelite frame.

3. The penetrable assemble magnetic energy generator, as recited in claim 1, wherein an engaging shoulder of said first magnetic member is coupled with an engaging shoulder of said second magnetic member to detachably couple said first and second magnetic members with each other and to ensure said projected pin and said elongated inserter being aligned with each other.

4. The penetrable assemble magnetic energy generator, as recited in claim 1, wherein said electromagnetic induction coil enwinding with said insulated thermosetting frame is selected from a group consisting of a single multi-enamel wire wrapped by an insulated casing, two or four of parallel entwisted multi-enamel wires wrapped with an insulated casing, a plurality of wires wrapped within an insulated casing with varied diameter or varied quantity, and a plurality of copper wires wrapped by said insulated casing, wherein a winding circle of said electromagnetic induction coil is a complete circle or as many as N circles.

5. The magnetic light, as recited in claim 4, wherein said insulated thermosetting frame is a insulated bakelite frame.

6. The penetrable assemble magnetic energy generator, as recited in claim 3, wherein said electromagnetic induction coil enwinding with said insulated thermosetting frame is selected from a group consisting of a single multi-enamel wire wrapped by an insulated casing, two or four of parallel entwisted multi-enamel wires wrapped with an insulated casing, a plurality of wires wrapped within an insulated casing with varied diameter or varied quantity, and a plurality of copper wires wrapped by said insulated casing, wherein a winding circle of said electromagnetic induction coil is a complete circle or as many as N circles.

7. The magnetic light, as recited in claim 6, wherein said insulated thermosetting frame is a insulated bakelite frame.

8. A magnetic light, comprising:

an airtight hollow light body having an inner cavity and a through slot; and a magnetic energy generator, which is coupled at said through slot of said light body, comprising:

an assembled magnetic body, which comprises:

a first magnetic member, having a trough-shaped structure, comprising a projected pin extending therewithin; and a second magnetic member, which is engaged with and covered with said first magnetic member, comprising an elongated inserter extended into said first magnetic member and aligned with said projected pin to define a fixed magnetic air gap between said elongated inserter and said projected pin;

an insulated thermosetting frame extended from said projected pin to said elongated inserter; and an electromagnetic induction coil enwinding with said insulated thermosetting frame from said projected pin to said elongated inserter through said magnetic air gap.

9. The magnetic light, as recited in claim 8, wherein said insulated thermosetting frame is a insulated bakelite frame.

10. The magnetic light, as recited in claim 8, wherein an engaging shoulder of said first magnetic member is coupled with an engaging shoulder of said second magnetic member to detachably couple said first and second magnetic members with each other and to ensure said projected pin and said elongated inserter being aligned with each other.

11. The magnetic light, as recited in claim 8, wherein said electromagnetic induction coil enwinding with said insulated thermosetting frame is selected from a group consisting of a single multi-enamel wire wrapped by an insulated casing, two or four of parallel entwisted multi-enamel wires wrapped with an insulated casing, a plurality of wires wrapped within an insulated casing with varied diameter or varied quantity, and a plurality of copper wires wrapped by said insulated casing, wherein a winding circle of said electromagnetic induction coil is a complete circle or as many as N circles.

12. The magnetic light, as recited in claim 11, wherein said insulated thermosetting frame is a insulated bakelite frame.

13. The magnetic light, as recited in claim 10, wherein said electromagnetic induction coil enwinding with said insulated thermosetting frame is selected from a group consisting of a single multi-enamel wire wrapped by an insulated casing, two or four of parallel entwisted multi-enamel wires wrapped with an insulated casing, a plurality of wires wrapped within an insulated casing with varied diameter or varied quantity, and a plurality of copper wires wrapped by said insulated casing, wherein a winding circle of said electromagnetic induction coil is a complete circle or as many as N circles.

14. The magnetic light, as recited in claim 8, wherein said light body having an inner cavity and a through slot, and comprising a fluorescent layer coated at said inner cavity, an inert air and mercury received within said inner cavity.

15. The magnetic light, as recited in claim 14, wherein said insulated thermosetting frame is a insulated bakelite frame.

16. The magnetic light, as recited in claim 10, wherein said light body having an inner cavity and a through slot, and comprising a fluorescent layer coated at said inner cavity, an inert air and mercury received within said inner cavity.

17. The magnetic light, as recited in claim 16, wherein said insulated thermosetting frame is a insulated bakelite frame.

18. The magnetic light, as recited in claim 13, wherein said light body having an inner cavity and a through slot, and comprising a fluorescent layer coated at said inner cavity, an inert air and mercury received within said inner cavity.

19. The magnetic light, as recited in claim 18, wherein said insulated thermosetting frame is a insulated bakelite frame.

* * * * *